United States Patent [19]

Targetti

[11] Patent Number: 4,866,583

[45] Date of Patent: Sep. 12, 1989

[54] SECTIONAL STRUCTURE FOR MOUNTING SPOT LIGHTS FOR FITTING OUT OF ROOMS AND OTHER

[76] Inventor: Giampaolo Targetti, Via Barbacane 29, 50133 Firenze, Italy

[21] Appl. No.: 140,486

[22] Filed: Jan. 4, 1988

[30] Foreign Application Priority Data

Sep. 1, 1987 [IT] Italy ..... 9470 A/87

[51] Int. Cl.[4] ..... F21S 3/04

[52] U.S. Cl. ..... 362/404; 362/148; 362/225; 248/343; 52/28

[58] Field of Search ..... 362/238, 145, 147, 225, 362/404, 148, 150; 248/343; 52/28

[56] References Cited

U.S. PATENT DOCUMENTS 3,121,259 2/1964 Versen ..... 52/28

4,086,480 4/1978 Lahm ..... 362/225 X

*Primary Examiner*—Stephen F. Husar

*Attorney, Agent, or Firm*—Hopgood, Calimafde, Kalil, Blaustein & Judlowe

[57] ABSTRACT

Flanking structural shapes and mechanical connection means between shapes disposed two-by-two in flanking relationship and two-by-two in abutting relationship make up structures for mechanical support and electrical connection, at low voltage (for example at 24 Volt), between abutted shapes. The web of the shapes having transverse bars at the ends, is defined by shearings in the same web. The bars being able to cooperate with coupling means comprise a plate body made of insulating material, shaped according to the cross-section dimensions of the structure and forming support edges adapted to receive, on their sides, the bars of the shapes to be coupled. Clamps for mechanical and electrical connection are developed with U-shaped cross-section for embracing the bars brought near the abutted shapes and the body thickness along the support sides, and are secured to the body.

14 Claims, 6 Drawing Sheets

Fig.6
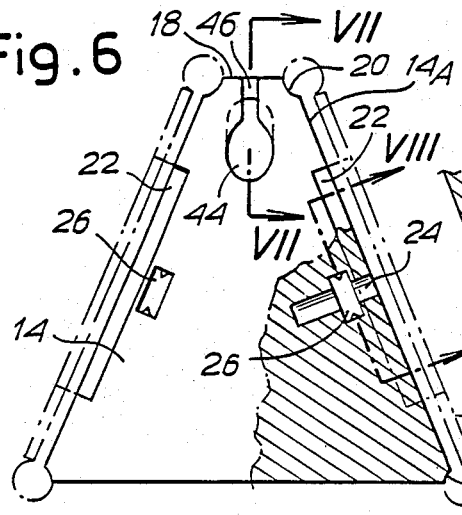
Fig.8
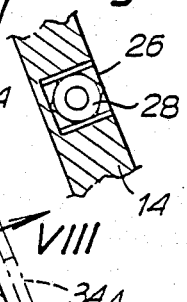
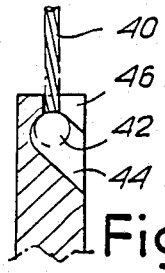
Fig.7
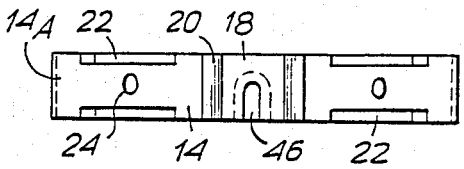
Fig.9
Fig.12
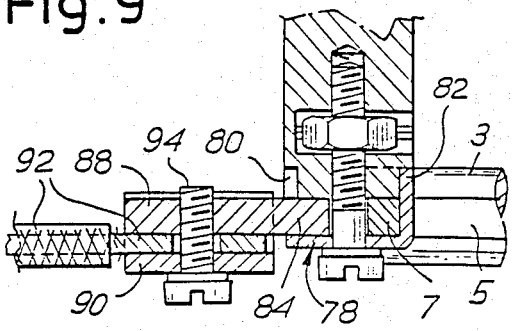
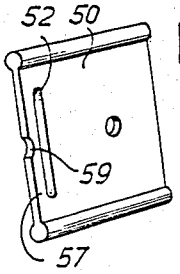
Fig.10
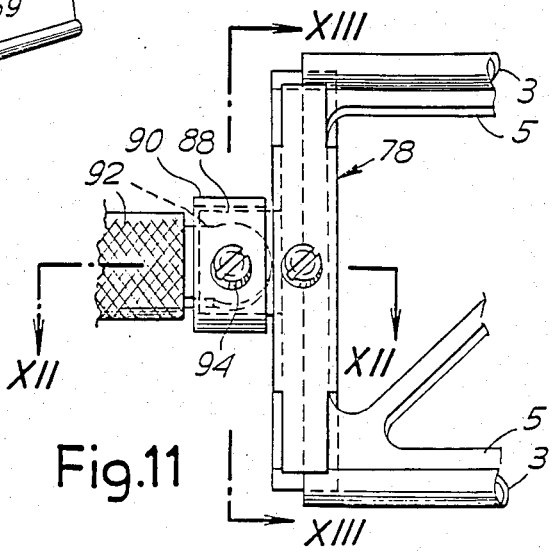
Fig.11
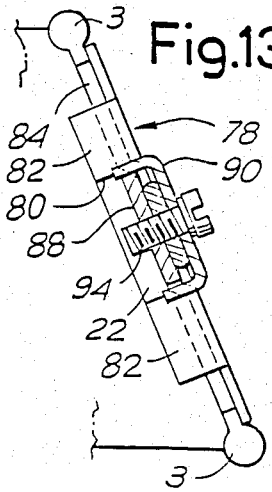
Fig.13

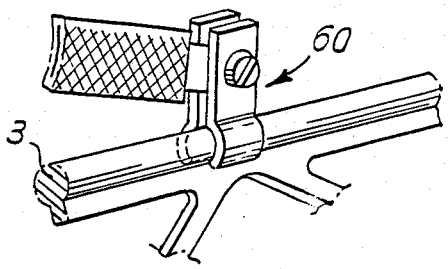
Fig.22
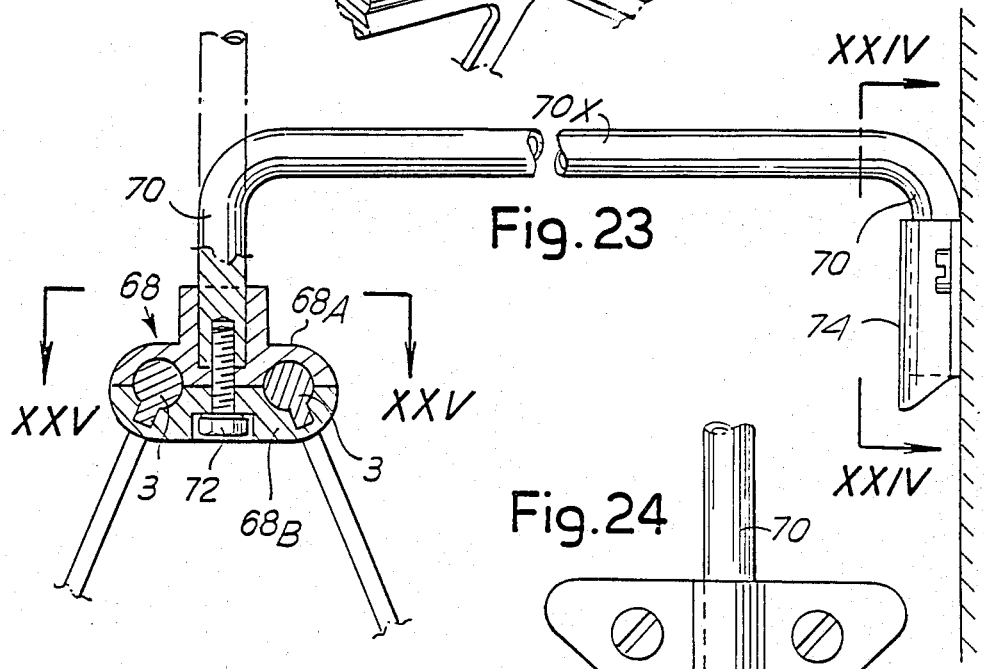
Fig.23
Fig.24
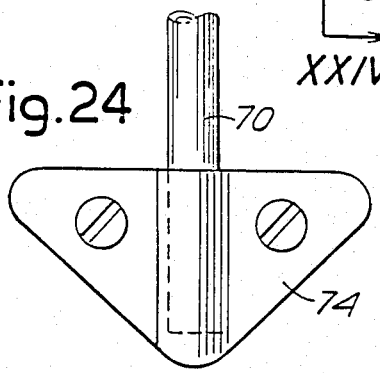
Fig.25
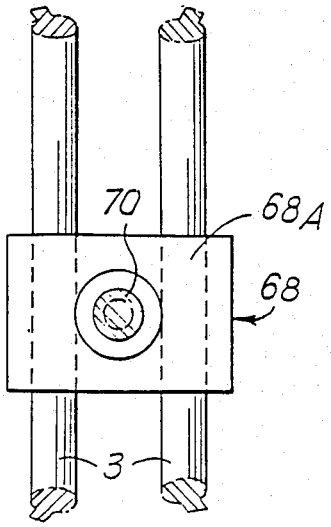
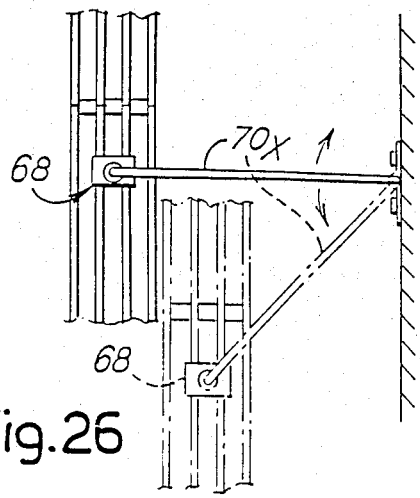
Fig.26

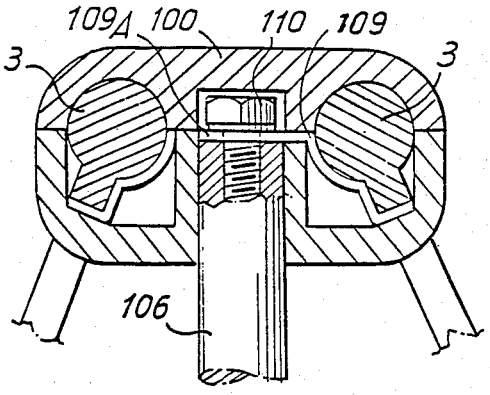
Fig. 28
Fig. 29
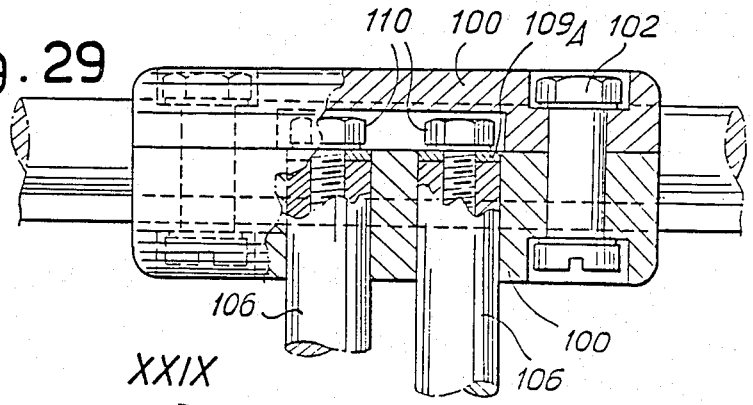
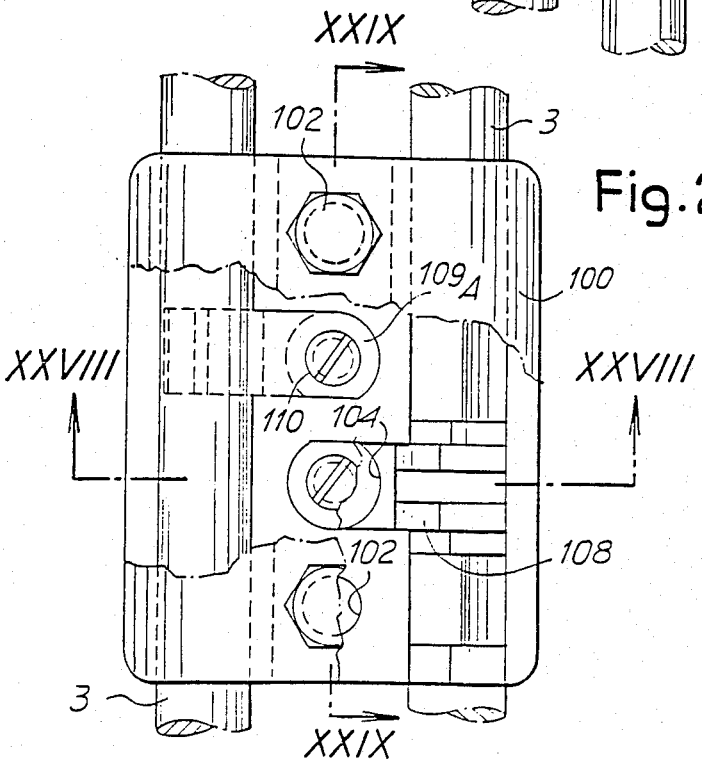
Fig. 27

SECTIONAL STRUCTURE FOR MOUNTING SPOT LIGHTS FOR FITTING OUT OF ROOMS AND OTHER

DESCRIPTION

The invention relates to a sectional structure for mounting lamps or spot lights and other, suitable for interior design or fitting out in general and for other uses. Said structure comprises flanking structural shapes and means for the mechanical and electrical connection between shapes disposed two-by-two in flanking relationship and two-by-two in abutting relationship.

Advantageously, each shape has two external longitudinal thickenings and a laminar web, said web may be pierced through shearing.

According to an embodiment of the invention, the webs of the structural shapes—having two thickenings and a joining web—have transverse bars defined by shearings in the same web at their ends; the connection means comprise a plate body made of insulating material, shaped according to the cross-section dimensions of the structure and forming support edges apt to receive, on their sides, the bars of the shapes to be coupled; and clamp means for the mechanical coupling and electrical connection—mostly at low voltage that is at a voltage less than or equal to 24 Volt—are developed with a U-shaped cross-section for embracing the bars brought near of abutted shapes and the thickness of the body along the support sides, and are secured to said body.

The clamp means may exhibit slightly inclined extensions of the intermediate side of the U-shaped cross-section, in order to ensure the electrical contact through the clamping or tightening pressure.

Each clamp means may be secured by a screw—even only one—which perpendicularly engages the support side of the bars and is received into a hole in the intermediate side of the U-shaped cross-section of the clamp means as well as into notches of the bars; said screw may be tightened to a nut housed and engaged into a seat formed in the body thickness and interfering with the hole of the screw; said seat may have projections for the shrinking that is forced retention of the nut.

The flanges or legs of the U-shaped cross-section length of the clamp means may be received into recesses of the body, especially corresponding to the thickness of said flanges or legs.

Said body may have on top a small groove and a notch to house a suspension tension rod that can be inserted in said groove and has a thickening which is received and retained in said notch.

Bend joining elements may be provided between parts forming an angle between them, each joining element comprising clamp means similar to the preceding ones with an interruption in one of the legs for a cable terminal solid with a bar disposed side-by-side to that of the shape to be electrically connected with the corresponding one of the angled element; the cable terminals are electrically connected with arcuate plaits possibly stiffened by a metal (like tin or other).

The invention will be better understood by following the description and the attached drawing, which shows a practical, non limitative exemplification of the same invention. In the drawing:

FIG. 6 is a cross section view on line VI—VI of FIG. 1;

FIGS. 7 and 8 are local section views on line VII—VII and VIII—VIII of FIG. 6;

FIG. 9 is a top view of a plate for the formation of a joint;

FIG. 10 is a perspective view of a terminal for the electrical connection;

FIG. 11, 12 and 13 show a connection between angled structures in an external view and in the section views on lines XII—XII and XIII—XIII of FIG. 11;

FIG. 22 shows a clamp means for the electrical connection on a structural shape;

FIGS. 23, 24, 25 show, in partially sectioned side view on lines XXIV—XXIV and XXV—XXV of FIG. 23, wall-mounting support;

FIG. 26 shows a way for adapting the distance of a structure made of structural shapes with respect to the application wall by means of said support;

FIGS. 27, 28 and 29 show, in plan view and in section views on lines XXVIII—XXVIII and XXIX—XXIX of FIG. 27, an adapter for hanging two rods for the mechanical and electrical connection of a spot light.

Figures 1, 2, 3, 4, 5:
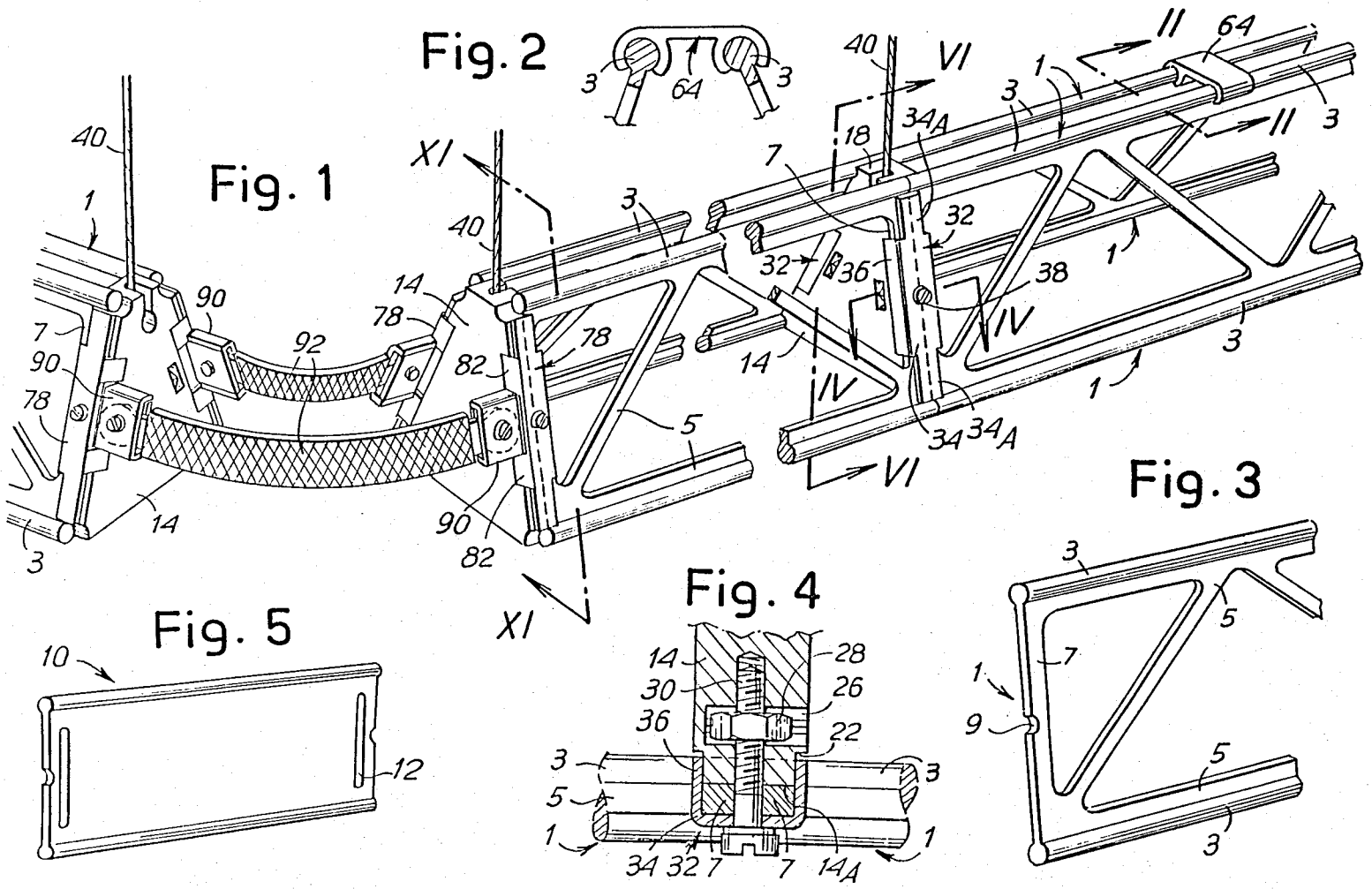
FIG. 1 shows a perspective view of two linear structures and a junction between them.
FIG. 2 shows a local section view on line II—II of FIG. 1.
FIG. 3 is a partial perspective view of the end of a structural shape.
FIG. 4 is a cross section view on line IV—IV of FIG. 1.
FIG. 5 is a perspective view of a compensating element.
Figure 14:
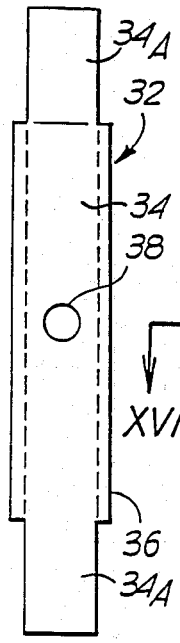
FIGS. 14, 15 and 16 show in two views and a section view on line XVI—XVI of FIG. 15, a clamp means for the mechanical and electrical connection.
Figure 15:
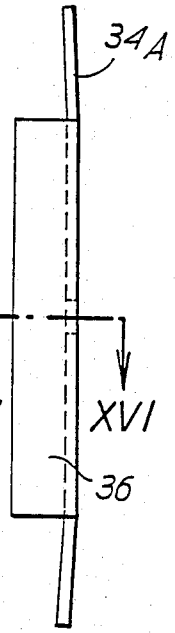
Figure 17:
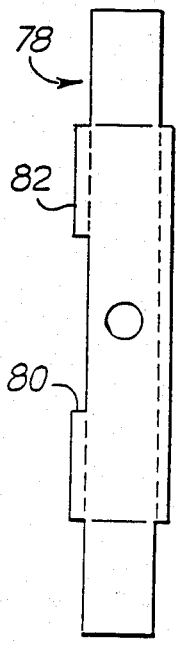
FIGS. 17, 18 and 19 show, in two views and in section view on line XIX—XIX of FIG. 18, a clamp means for an angled junction.
Figure 18:
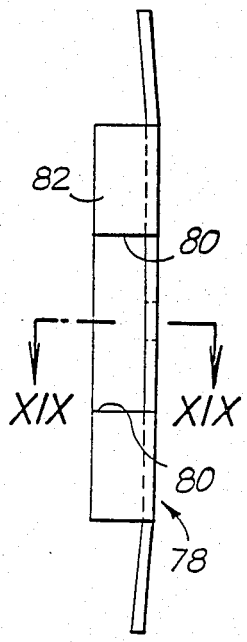
Figure 16:
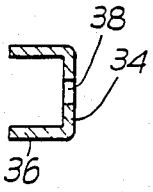
Figure 19:
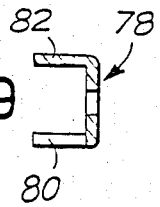
Figure 20:
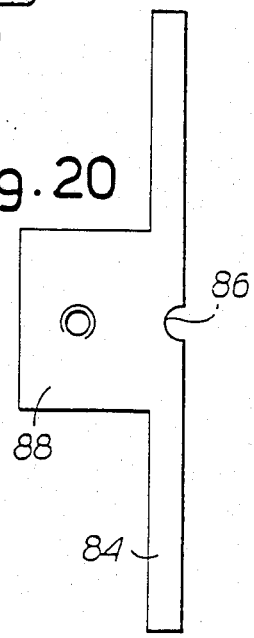
FIGS. 20 and 21 show a component to be utilized with the above mentioned clamp means.
Figure 21:
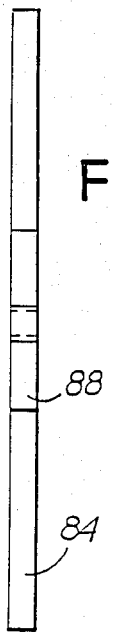

The basic structure (FIGS. 1 to 21) of the assembly in question is represented by a pair of structural shapes, mostly extruded, which are coupled between them according to a relative inclination and with connection means apt to establish the position of the flanking shapes and to connect the abutted shapes. Each shape, generally indicated by 1, comprises two end longitudinal thickenings 3 and a laminar part 5, which may be slotted for lightening purposes through a work operation subsequent to the profiling and, in any case, is provided with openings which delimit bars 7 along the end transverse edge. Each bar 7 has an intermediate notch 9. The structural shapes may have standardized lengths to obtain various possibilities of composition and with said shapes complementary elements indicated by 10 may also be formed having short lengths in the range, for example, of 75 mm of 150 mm, which will have, owing to their limited dimension, a non-sheared web and will then exhibit—in order to form bars like those indicated by 7—elongate slottings 12.

In order to join four shapes between them, disposed two-by-two in side-by-side relationship and two-by-two in lengthwise abutting relationship, junction supports are provided able to ensure both the mechanical coupling and the electrical connection between abutted shapes and the possibility of suspension of the assembled structure. The electrical connection is required for the possibility of distributing the low voltage electric power through the same shapes which make up the basic components 1 of the mechanical structure.

Each support, that is each joint, comprises a plate 14 made of insulating material that may be of synthetic moulded resin even and advantageously transparent, of generally isosceles triangle development with the base angles being bevelled at 16 and the vertex being truncated at 18 and having the angles bevelled at 20. The distance between bevels 16,20 corresponding to the distance between the thickenings 3 of the structural shapes 1, which have to rest along the sides 14A of the body 14. Along said sides 14A, longitudinal recesses 22 are provided, developed over a portion of the length of sides 14A and at an intermediate position; the width of sides 14A in the thickness direction, in correspondence with said recesses 22, corresponds to twice the width of bars 7 which define the terminal edge of shape 1. At central position of recesses 22, and at intermediate position of body 14 thickness, a hole 24 is provided along each side 14A perpendicular thereto, said hole 24 intercepting a side slot-like hole or opening 26 originating in one of the surfaces of the thickness of body 14 and involving part thereof without reaching the opposite surface of same body thickness; in these slot holes or openings 26 light ribs 26A are formed lengthwise with respect to the development of same slots 26, having the purpose of retaining a nut that may be inserted with some forcing into the slot 26; the nut indicated by 28 makes part of a means for the electrical and mechanical connection of the structural shapes that are abutted along the side 14A. For the fastening and the connection, a screw 30 is utilized which is inserted into the hole 24 and screwed into the nut 28 so as to engage both the two structural shapes 1 and a clamp means generally indicated by 32, for the mechanical and electrical connection.

Each clamp means 32 is developed as a metal plate of suitable thickness, forming a strip 34 of a width corresponding to that of sides 14A in correspondence of recesses 22, and two longitudinal legs 36 developed in the intermediate part of strip 34, to make up a "U" section of the clamp means, from which longitudinal terminal portions 34A of strip 34 extend; these portions 34A are slightly inclined with respect to the plane of strip 34 in the zone comprised between legs 36. At an intermediate position, strip 34 has a hole 38 provided for the screw 30. The interspace between legs 36 corresponds to the interspace between recesses 22, and the length of legs 36 corresponds to the longitudinal extension of recesses 22, while the height of legs 36 (as measured inside the U-section) corresponds to the sum of the width of recesses 22, starting from the corners of sides 14A, plus the thickness of webs 5 that is of the bars 7 of shapes 1.

To connect the two abutting shapes 1 of each one of the two pairs of flanking shapes, a joint support is used which comprises the body 14 and two clamp means 32 for the two pairs of two-by-two abutted shapes 1. A pair of abutted shapes 1 has bars 7 disposed side-by-side side with a central passage formed by the two notches 9; a body 14 is brought near to flanking bars 7 so that these may rest on the thickness of side 14A thereby taking up the width of said side in correspondence of recesses 22. A clamp means 32 is then fitted on side 14A, so as to present legs 36 into recesses 22, embracing through the U-section the bars 7 of the two shapes and the portion of body 14 in correspondence of recesses 22. The connection is stabilized and forced by means of screw 30 which goes through the hole 38 defined by the two notches 9A, corresponding to each other, of the two abutted bars and enters the hole 24 to engage nut 28 tranversally inserted into slot 26. It is thus possible to carry out a mechanical connection by simply using a screw 30. The nut 28 is kept in the position wherein the threaded hole is in correspondence of hole 24, because of the dimensioning of slot 26 and the retention effect operated by the two ribs that is projections 26A which warp to a limited extent in relation to the more or less forced insertion of nut 28. It should be noted that the surface of strip 34, 34A—which is inside the U-section of clamp means 32—comes to coincide that is to match with bars 7 of the two abutted shapes 1, and the end parts 34A of strip 34 come to force—through the tightening of screw 30—on the surfaces of the two shapes 1 in correspondence of bars 7 and adjacent to thickenings 3, thereby ensuring an elastic pressure and thus an electrical contact allowing a safe electrical connection between the two abutted shapes.

By mounting two pairs of shapes in abutment relationship on the same joint body 14, there is obtained a mechanical coupling and an electrical connection which are after all obtained in a simple way by using the two screws 30. The thickenings 3 are caused to go near to bevels 16 and 20 thus ensuring the accurate positioning of body 14 on shapes 1 and, in particular, on bars 7 which must result in abutting relationship.

In correspondence to the vertex of body 14 being flattened at 18, a suspension arrangement of the joint is provided—and thus of the structure mounted thereon—by means of a cable like that indicated by 40 and which has, at its lower end, a spherical thickening 42 that may be welded thereon. For the engagement of the suspension cable 40, 42, an inclined notch 44 is provided in the zone of the truncated vertex, this notch being able to receive the spherical thickening 42, forming a hemispherical seat for receiving same cable in its end upper part; a slot 46 is formed between the truncated end 18 of the vertex and the notch 44 for allowing the passage of cable 40, the slot 46 limited to the cable dimension. Under these conditions, an upwardly tensioned cable with its own spherical thickening 42 inserted into the notch 44 and reacting on the bottom thereof turned towards the truncated vertex 18, ensures a steady connection by means of anchorage means, for example provided in the ceiling and suitably covered for aesthetical requirements. It is therefore possible, through the simple insertion of a cable 40, 42 into the recess 44 and into the slot 46, to establish the connection with the suspension means.

According to what hereinbefore stated, it is possible, by means of clamp means 32, to ensure the low-voltage electrical connection between two abutted shapes 1. These shapes can be made of aluminum or other relatively light metal or alloy yet sufficient to ensure the electrical conductivity for the power supply to light spots or other which may be combined to the structure in question. The structural shapes 1 have a cross-section sufficient to provide electricity transmisson, for both the cross-section of thickenings 3 and the portion of web 5, that is, kept continuous by the shearing of said web for lightening sake, said shearing being able to be developed with triangular slots to give rise to a substantially trestle-like structure.

Numeral 50 indicates a cable terminal that is a feeder that may be applied as a continuation of a shape 1 through the same already described clamp means provided in correspondence with a joint body like the one indicated by 14; this cable terminal has a slot 52 for the clamp means, said slot being apt to define a bar 57, similar to that indicated by 7 of the shapes, and a notch 59 corresponding to those indicated by 9. The cable terminal 50 will be possibly provided with holes or other means for the tightening or clamping of a cable.

To supply or even draw electrical current, a clamp means 60 may be used (FIG. 22) having two substantially symmetrical jaws, which is apt to embrace a thicknening 3 of shapes 1 in order to clamp it while leaving a sufficient space between the jaws for the thickness of web 5.

Figure 35:
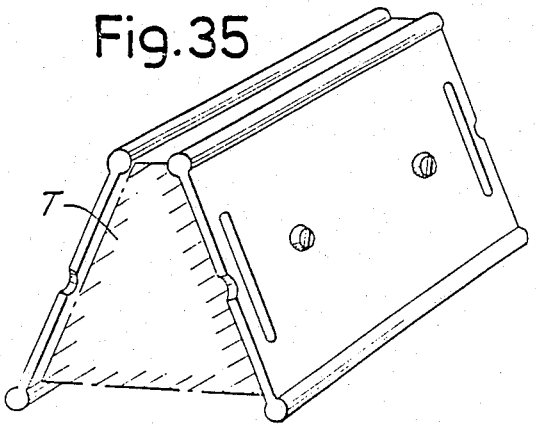
FIG. 35 shows a possible arrangement of a transformer between two structural shapes in inclined position.

A beam structure made up of two shapes 1 connected with the joint bodies 14 may also house a transformer with low voltage output as indicated by T in FIG. 35, which, besides constituting a possible connection between the two beams, can ensure the power transformation from the main voltage to the low voltage, that is, to a value below or equal to 24 Volt, for the power supply of shapes 1 and can also ensure the electrical connection with said shapes. The tightening or clamping of surface clamp means can be even provided on the inclined walls of the body of transformer T which match shapes 1, while the electrical connection for the inlet cable may be carried out in any suitable position.

In order to stabilize the interspace between the adjacent upper thickenings 3 of the two side-by-side disposed shapes, a spacer indicated by 64 may be provided (FIGS. 1 and 2), which may be made of synthetic resin with the possibility of a slight elastic yielding for the snap engagement thereof. Such a spacer may also be utilized for suspension connections or for accessories to be connected to the structure.

For the application, a wall-mounting system may also be provided as indicated in FIGS. 23 to 26. A clamp means 68 is realized with two valves 68A and 68B which define, upon their coupling, two clamping seats for the two side-by-side disposed thickenings of the two shapes and for the respective portions of web 5 thereof that are adjacent to the thicknenings. The clamp means 68 may be disposed at any position along the slottings provided for the shapes. Part 68A may be engaged to a stem 70 and the tightening of the clamp means may be provided by a simple screw 72, axially disposed with respect to stem 70. The stem 70 may be straight for a ceiling mounting, or curved, anyway to give rise to a cantilever arm indicated by 70X which may be applied to a wall through a plate support 74. The arm 70X may be realized for articulated engagement thereof both to plate 74 and to portion 68A of clamp means 68, in order to ensure the wall connection at distances adjustable through the inclination of said arm with respect to the wall.

The straight structures described above may be joined both mechanically and, in particular for the electrical connection, by bend arrangements mostly forming 90° or even different angles, with connections being predisposed to the combination with the above mentioned joint supports involving body 14 and with clamp means of special types but similar to those for the shape-to-shape connection.

A clamp means 78 similar to that indicated by 32 is differentiated from the latter by the presence of an interruption 80 in correspondence of one of the legs 82 of same clamp means. The clamp means 78 provides for the engagement to a body 14 of both a bar 7 of the concurrent shape and a bar 84 with dimensions similar to those of bar 7 and provided, likewise the latter, with an intermediate notch 86 and further provided with a clamp appendix 88 which forms a tang capable of being received in the slotting 80 of the clamp means 78. The clamp means 78 is thereby able, through a screw similar to that indicated by 30, to mechanically block and electrically connect both shape 1, 3, 5, 7—concurrent with the joint support—and the bar 84 and thus the clamp means 88; by means of a U-shaped clevis 90, a cable terminal of a plait 92 may be clamped to the clamp means 88, said plait being bent to reach another similar clamp means formed by pieces 84, 90, 78 of another support belonging to a structure adjacent and angularly disposed with respect the one considered. The plaits 92 are bent according to the angulation requirements and have lengths meeting the curvature requirements; said plaits may be kept flexible or even blocked by dipping them in a weld metal like tin or other in order to stabilize their mechanical configuration and allow them to perform a stiff connecting function of mechanical type in addition to that of electrical type. In place of plaits 92, another suitable type of conductor may also be utilized. In any case, the conductor, like a plait 92 or other, is forcedly clamped between the appendix 88 and the clevis 90 through screws 94 or other equivalent means to make up a clamp means.

FIGS. 27 to 29 show an adapter body for the suspension of a pair of rods intended to provide the mechanical and electrical connection of a spot light or other, the rods being downwardly developed from the upper and close thickenings 3 of the two shapes of a pair of shapes; the adapter is capable of being engaged at any point along the slottings of the side-by-side disposed shapes. The body of the adapter consists of two pieces 100 which, when coupled, form a vice that is a clamping means able to clamp the two upper and close thickenings 3 of a pair of side-by-side disposed shapes 1; it is not excluded that in a reversed arrangement, the vice might be predisposed to be connected to the lower thickenings of the structure. The two side-by-side disposed pieces 100 are connected between them by screws 102 and nuts 103 housed into respective seats along a longitudinal central plane on the sides of a pair of seats 104; said seats are of use to receive sticks that is rods 106, downwardly developing for the mechanical support of and the electrical connection with the spot light. In correspondence with seats 104 (which may be non-circular for an accurate positioning of rods 106), housings 108 are formed on opposite sides of said central plane, wherein contact plates 109 may be received being disposed and shaped so as to embrace the thickenings 3 and to be forced thereon by the clamping of the two vice valves 100. Moreover, each plate 109 has a part 109A which is bored for receiving the ends of rods 106 which are fixed by screws 110 axially engaging threaded holes of the respective rod 106, in order to thus tighten the end 109A of the relevant plate 109 and ensure the mechanical coupling as well as the electrical connection. Alongside the rods 106 which result side-by-side disposed, or at the end of same rods, a spot light of traditional type is applied.

Figure 30:
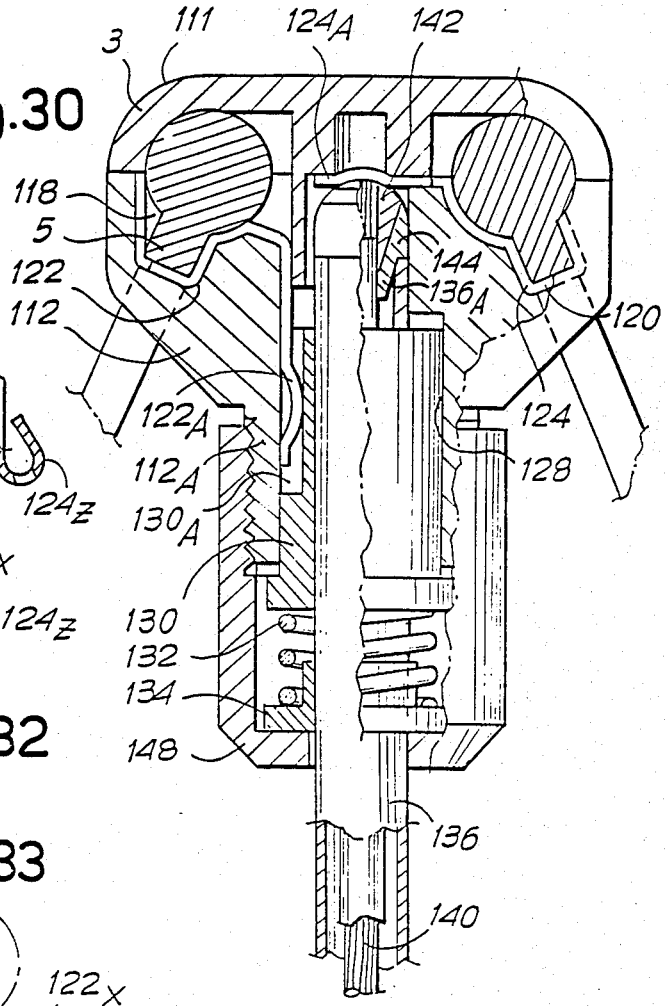
FIG. 30 shows, in a view and a partial section view, an adapter for the suspension of a lamp or other with coaxial connectors.
Figure 31:
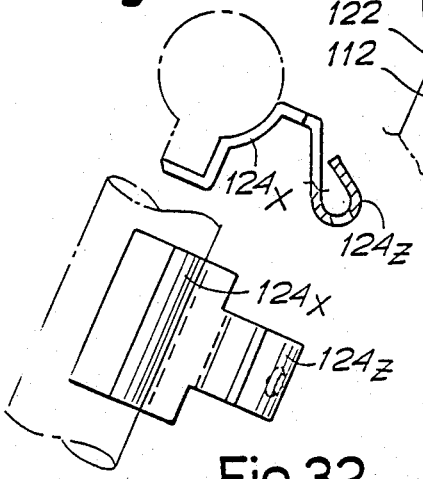
FIGS. 31 to 34 show modified embodiments of internal connectors of an adapter similar to that of FIG. 30.
Figure 32:
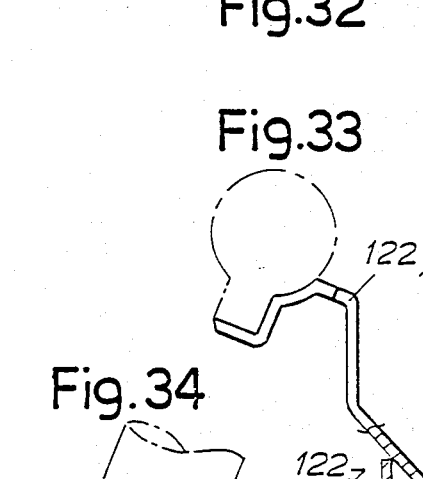
Figure 33:
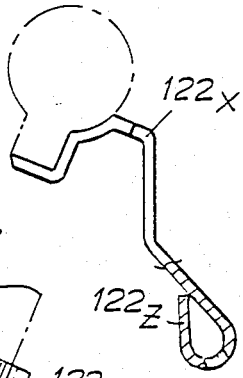
Figure 34:
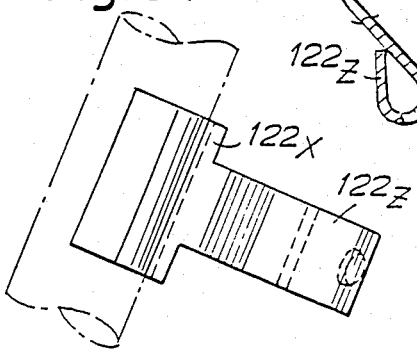

FIG. 30 shows an adapter for taking up power and forming a mechanical rotation support of whatever lamp or spot light. This adapter comprises two bodies 111 and 112 capable of being clamped by intermediate screws (as provided for the preceding arrangement), seats 114 and 116 being provided for said screws. The pieces 111 and 112 form through seats for the thickenings 3 of shapes 1 and for the respective portion of web 5 adjacent to thickenings 3, the fastening being predisposed at any position along the slottings of the shape webs. The body 112 forms two housings 118 and 120 in intermediate position for two strip contacts 122 and 124. Contact 122 has an elastic longitudinal appendix 122A, while strip 124 has a tang-like transverse appendix 124A which extends into the central zone of the adapter made up of the bodies 111 and 112. These two bodies form a central seat 128, into which a metal bush 130 may be inserted, being pushed into the housing 128 by a spring 132 which also rests on a flange 134 made solid with a metal tubular rod 136 by a welding, for example. This metal rod 136 makes up one of the two conductors and also forms the external stem for the support of the lamp or spot light associated with the adaptor which is being described. Inside the rod 136 and insulated thereform, a second conductor 140 is provided which has its end welded to a truncated cone head 142 received in a truncated cone glass 144 made of insulating material; the glass is fitted on the correspondingly shaped end 136A of the tubular rod 136. On to an extension 112A, which is externally threaded and surrounds the seat 128 of body 112, a cap 148 is screwed, which is able to exert a force on flange 134 and thus on spring 132 thereby determining the axial sliding contact of head 142 of conductor 140 against the tang 124A of the strip contact 124; in addition, cap 148 ensures some friction resistance against the rotation of the assembly made up of rod 136 and flange 134 which is able to rotate about the sleeve or tube 130. The sleeve 130 comes into contact with tang 122A which makes up the extension of contact 122; the tang 122A is received into a notch 130A of the sleeve or tube 130; consequently, the contact 122 sets up the electrical connection between the relevant thickening 3 and the rod 136 through the sleeve or tube 130.

By this adapter disposition, it is possible to position same adapter in any position along a pair of shapes 1, 3, 5 and it is possible to obtain an angular orientation about the axis of rod 135 and conductor 140, which represent the mechanical support and the electrical connection of the adapter with the spot light.

According to the modified embodiment shown in FIGS. 31 to 34, in place of contacts 122, 124, strip contacts 122X and 124X are provided which have curved appendixes 122Z and 124Z apt for the connection with plug terminals of traditional-type electrical conductors being inserted into holes of said appendixes 122Z and 124Z for a fast connection through a possible squeezing of same appendixes.

A very low cost structure can thus be realized in described manner, which can be easily assembled and is made up of a relatively small number of pieces thus allowing an easy storage. These and other objects and advantages will be apparent to those skilled in the art from the description herein set forth.

It is understood that the drawing shows an exemplification given only as a practical demonstration of the invention, as this may vary in the forms and dispositions without nevertheless departing from the scope of the idea on which the same invention is based. The possible presence of reference numerals in the annexed claims has the purpose of facilitating the reading of the claims, reference being made to the description and drawing, and does not limit the scope of the protection represented by the claims.

I claim:

1. A sectional structure for mounting spot lights and for other uses, characterized by the fact of comprising flanking disposed structural shapes and means (14,32) for the mechanical connection between structural shapes(1) disposed two-by-two in flanking relationship and two-by-two in abutting relationship, and for the electrical connection between abutted shapes; and wherein each shape (1) has two external longitudinal thickenings (3) and a laminar web (5).

2. Structure according to claim 1 characterized by the fact that said laminar web (5) is pierced through shearing.

3. Structure according to claim 2 characterized by the fact: that the webs (5) of the shapes (1)—having thickenings (3) and a joining web (5)—have transverse bars (7) at their ends defined by shearings in the same web; that the connection means comprise a plate body (14) made of insulating material, shaped according to the cross-section dimensions of the structure and forming support edges able to receive on the sides thereof said bars (7) of shapes (1) to be coupled; and that clamp means (32) for mechanical coupling and electrical connection are developed with a U-shape section (34, 36) to embrace bars (7) brought near of abutted shapes (1) and the body thickness along the support sides, and are fixed to said body.

4. Structure according to claim 3, characterized by the fact that the clamp means have slightly inclined extensions (34A) of the intermediate side of the U-section to ensure the electrical contact through the clamping pressure.

5. Structure according to claim 4, characterized by the fact that each clamp means is fastened through a screw (30)—even only one—which engages at right angle the supporting side of bars and is received into a hole (38) of the intermediate side (32) of the U-section of the clamp means and into notches (9) of the bars; said screw (30) being able to be tightened to a nut (28) housed and engaged into a seat (26) formed in the thickness of the body (14) and interfering with the hole of screw (30); said seat (26) possibly having projections for the forced retention of the nut.

6. Structure according to claim 5, characterized by the fact that the legs (36) of the U-section length of clamp means (32) are received into recesses (22) of the body (14), especially corresponding to the thickness of said legs.

7. Structure according to claim 3, characterized by the fact that in its upper part said body has a groove (46) and a notch (44) for housing a suspension tension rod (40) that can be inserted in said groove and having a thickening (42) which is housed and retained in said notch.

8. Structure according to claim 3, characterized by the fact of comprising bend-joining elements between structure parts angularly disposed to each other, each joining element comprising clamp means (78) similar to the preceding ones with an interruption (80) in one of the legs for a cable terminal (88) solid with a bar (84) side-by-side disposed with respect to that indicated by (7) of shape (1) to be electrically connected with the corresponding one of the angled element; the cable terminals (88) being electrically connected with arcuate plaits (92) possibly stiffened by a metal.

9. Structure according to claim 3, characterized by the fact of comprising a clamp-means support (68) that can engage thickenings (3) of two side-by-side disposed shapes, to which clamp a suspension or support arm (70–70X) is engaged that can be oriented relative to the shapes and to a support (74) of wall mounting-type articulation; the clamp-means support being tightened through a single screw (72) which is able to connect said arm (70) with the support and determine its orientation as desired.

10. Structure according to claim 3, characterized by the fact of comprising compensating means (10) respectively cable terminals (50) made up of short lengths of shapes (1) with slots (17, 52) defining the bars for the connection through the clamp means (32).

11. Structure according to claim 10, characterized by the fact of comprising a transformer (T) with low voltage output, fitted between two flanking shapes; said transformer possibly having surface clamp means for the clamping against the shape webs.

12. Structure according to claim 10, characterized by the fact of comprising an adapter with two pieces (100) clamp-like tightened on two adjacent thickenings and to which adapter rods for spot lights are fitted; within said two pieces, plates being housed for the contact with the thickenings and the anchorage of said rods.

13. Structure according to claim 3, characterized by the fact of comprising an adapter with two pieces (111, 112) which receive a rod (136), capable of being oriented, with sliding contacts made up of plates (122, 124) forced on the thickenings (3) of adjacent shapes (1) by the action of two pieces (111, 112) clamped to one another.

14. The structure of claim 1, further comprising an adapter for the suspension of a lamp or other with coaxial connectors (136-140) on a rail made of two linear supports (5) comprising end longitudinal thickenings (3) which form electrical conductors, said adapter comprising: two bodies (111; 112) which can be coupled together and form two seats for said two end longitudinal thickenings (3) as well as a central seat (128) for a tubular rod (136) forming one of the coaxial connectors; a metal bush (130) slidingly housed in the central seat (128), the tubular rod (136) being axially and angularly displaceable in said bush (130); a flange (134) integral with said tubular rod (136); a cap (148) screwed to an extension (112A) of the body (112) which supports said flange (134) and said tubular rod (136) in the axial direction allowing their rotation; a spring acting between the flange (134) and the metal bush (136); a first shaped strip contact (122, 122A) which is in contact with said metal bush (136) and with one of said thickenings (3); a second strip contact (124) which is in contact with the other of said thickenings (3) and forms a transverse appendix (124A) which extends into the central zone of the adapter; and on the end of the tubular rod (136) a cone glass (144) which houses a cone head (142) which is welded to one (140) of said coaxial connectors (136-140) thus forming a rotating contact with said transverse appendix (124A).

* * * * *